United States Patent [19]

Wechner

[11] Patent Number: 4,650,254

[45] Date of Patent: Mar. 17, 1987

[54] BIT HOLDER

[75] Inventor: Edward Wechner, Minnamurra, Australia

[73] Assignee: Joy Manufacturing Company, Pittsburgh, Pa.

[21] Appl. No.: 676,363

[22] Filed: Nov. 29, 1984

[30] Foreign Application Priority Data

Dec. 14, 1983 [AU] Australia ..... PG2854

[51] Int. Cl.[4] ..... E21C 35/18

[52] U.S. Cl. ..... 299/91; 299/93

[58] Field of Search ..... 299/91–93

[56] References Cited

U.S. PATENT DOCUMENTS

| | | | |
|---|---|---|---|
| 1,615,738 | 1/1927 | Bowman . | |
| 2,020,215 | 11/1935 | Ross . | |
| 2,028,811 | 1/1936 | Simmons . | |
| 2,131,188 | 9/1938 | Osgood . | |
| 2,439,400 | 8/1943 | Simmons | 299/93 |
| 3,429,617 | 2/1969 | Lauber | 299/93 |
| 3,519,309 | 7/1970 | Engle et al. | 299/91 |
| 4,094,611 | 6/1978 | Harper et al. | 299/91 X |
| 4,240,669 | 12/1980 | Rollins | 299/91 X |
| 4,275,929 | 6/1981 | Krekeler | 299/91 |
| 4,302,055 | 11/1981 | Persson | 299/93 |
| 4,337,980 | 7/1982 | Krekeler | 299/91 |
| 4,404,761 | 9/1983 | Paulin et al. | 299/91 X |
| 4,542,943 | 9/1985 | Montgomery, Jr. | 299/91 X |
| 4,557,525 | 12/1985 | Merten et al. | 299/93 |

FOREIGN PATENT DOCUMENTS

| | | | |
|---|---|---|---|
| 1468477 | 12/1966 | France | 299/91 |
| 855172 | 11/1960 | United Kingdom | 299/91 |

*Primary Examiner*—Stephen J. Novosad
*Assistant Examiner*—Michael A. Goodwin
*Attorney, Agent, or Firm*—Raymond W. Augustin

[57] ABSTRACT

A bit holder for a replaceable bit is disclosed. The bit is of the type having a pointed head portion axially extending from a shaft portion. The bit holder has a holder part for receiving the bit and has a base part for securing to a cutter head. The bit holder part is releaseably secured to the base part for easy replacement. The holder part has at least one reaction surface cooperating with one reaction surface on the base part for counteracting forces arising on the bit while cutting. A bolt extending from the holder part or the base part into a cooperating aperture in the other of the holder part of the base part is utilized to releaseably secure the two pieces together with the reaction surfaces therebetween. The bolt is positioned relative to the reaction surfaces and with respect to the bit so that the gripping force of the bolt counteracts the force of the bending moment created between the bit tip and the reaction surfaces during cutting.

11 Claims, 14 Drawing Figures

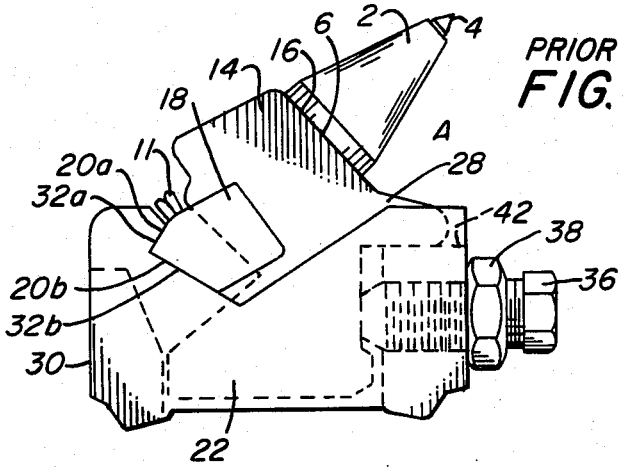
PRIOR ART
FIG. 1
PRIOR ART
FIG. 2
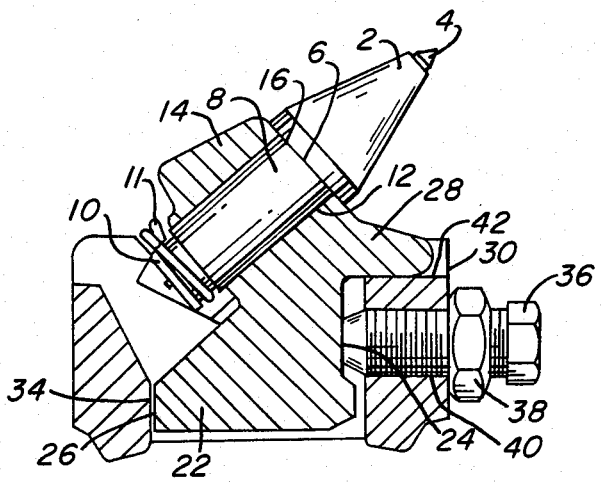
PRIOR ART
FIG. 3
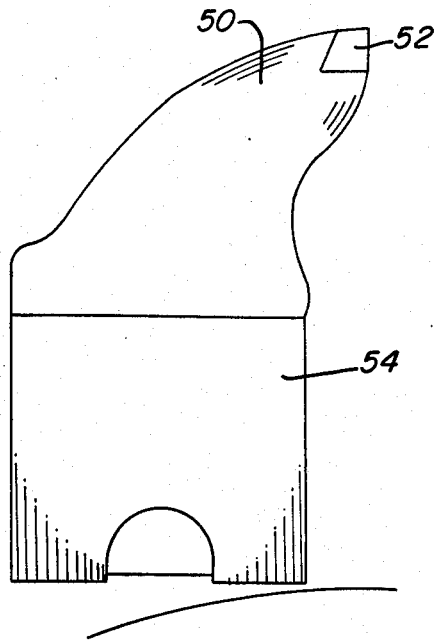

SECTION BB

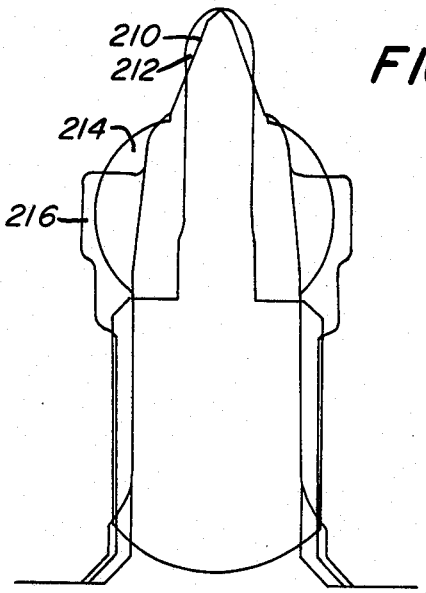
FIG. 10
FIG. 11
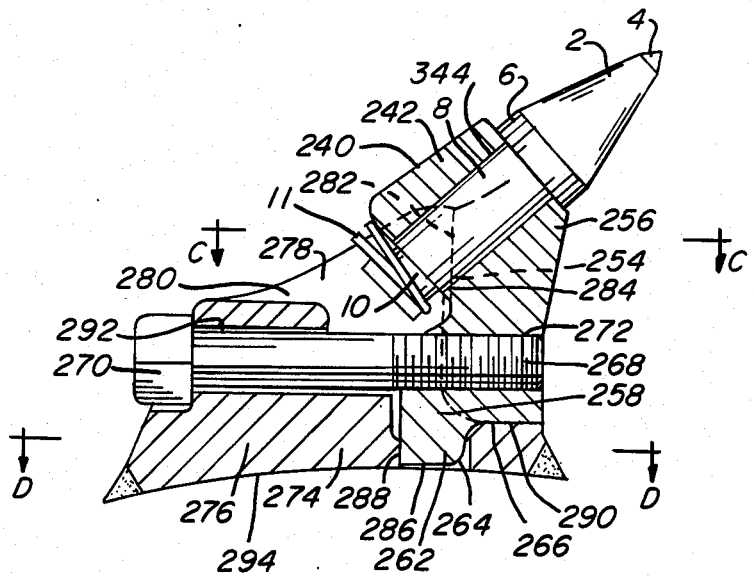

SECTION D D

SECTION C C

BIT HOLDER

BACKGROUND OF THE INVENTION

This invention relates to a bit holder for a replacement bit of the cutting head of a mining machine.

Because of the forces on a bit of a cutting head during mining and the abrasiveness of the contact of the bit with the mined material, e.g. coal, bits are subject to high wear and must be replaced at periodic intervals. There have therefore been numerous developments both in the design of the bit to achieve low cost and reliability and in the design of the bit holder to achieve a secure fixing of the bit which permits easy bit replacement.

A form of bit in common use is shown in FIGS. 1 and 2. The bit comprises a conical head member with a tungsten carbide tip 4 and a square section shoulder 6. A shaft portion 8 is provided and a groove 10 at the end of the shaft receives a retaining spring 11. Shaft 8 is insertable in a bore 12 of a bit holder 14. The shaft 8 extends through the bore 12 so that the groove 10 projects from the rear of the bore 12 whereby retaining spring 11 can be affixed to the groove by means of pliers in order to clamp the bit to the bit holder. When clamped the rear surface of right angled shoulder 6 abuts against the front face 16 of the holder in order to transfer the axial loading of the bit to the bit holder. Such a bit has numerous advantages, namely is simple construction, the effective way in which forces are transferred to the bit holder, and the fact that in use, the bit rotates in the holder so that the bit is evenly worn around its tip.

There are various wellknown modifications to the above type of bit. For example the square section shoulder of the conical head may be replaced with a tapering shoulder. The shoulder may be dispensed with altogether in which case the bit is of pencil form and is secured by its end resting on an anvil portion of the bit holder. In cases where the bit is secured in a bit holder so that its end is not accessible, bits have been designed with a resilient "wedding band" around the shaft of the bit which is compressible so that the shaft of the bit can be inserted into a bore of the bit holder, the wedding band being thereafter expandable into an enlargement of the bore to retain the bit in the bore.

The present invention is particularly concerned with bits of this type, namely bits having a pointed head portion axially extending from a shaft portion.

As regards the form of the bit holder, the design considerations must take account of two conflicting requirements namely the problem of wear of the bit holder and the problem of secure fixing of the holder to the cutting head. In addition the bit must be easily replaceable in the holder.

One common form of bit holder construction is to provide a two part holder having a base part and a holder part. The base part is securely attached to the cutting head, such as for example by welding the base part to a rotating drum of the cutting head. The base part is arranged releasably to secure the holder part so that the holder part can be replaced simply if it subject to wear while the base portion which is not usually exposed to the same amount of wear can be left in position. Problems have arisen with bit holders of this two part construction in releasably securing the holder part to the base part. One approach has been to provide a base part formed as two opposing side members defining therebetween a channel into which fits an elongate depending lug of the holder part. A pin releasably secures the elongate lug in the channel. However movement of the lug in the channel has provided to be excessive and has caused unnecessary wear of the holder part and base part.

To meet this problem the bit holder as shown in FIGS. 1 and 2 was devised. This bit holder is the subject of Australian patent application Nos. 50887/79, 12509/83 and 12510/83 and has two parts, a holder part 14 and a base part 30. The holder part has transversely projecting leg sections 18 projecting to the side of the holder part having upper and lower reaction surfaces **20*a* and 20*b*. A locating shank portion 22 is provided projecting directly beneath the bit 2. Shank portion 22 has vertically extending front and rear reaction surfaces 24,26. A forward extension portion 28** is provided projecting forwardly beneath the bit.

The holder part 14 is mounted in a base part 30. The base part is of generally rectangular shape but has side walls cut away to provide reaction surfaces **32*a* and reaction surfaces 32*b* generally at right angles to surfaces 32*a*. These reaction surfaces 32*a* and 32*b* co-operate with the reaction surfaces 20*a* and 20*b* of leg members 18 of the holder part. In addition the rear wall of base part 30 has a vertically extending flat surface 34 for co-operating with rear vertical reaction surface 26 of shank portion 22. In order to locate and lock the holder part into the base part, a set screw 36 and jam nut 38 are provided for threading into a bore 40 in the front face of base part 30. The end of set screw 36 abutts against the vertical front face 24 of shank portion 22 of the holder part. This has the effect of jamming the reaction surfaces 30*a*, 30*b* and 26 of the holder part against the reaction surfaces 32*a*, 32*b* and 34 of the base part. Sideways twisting movement is prevented by forward extension portion 28 engaging a mating groove 42 in the top surface of the base part 30**.

In use, the reaction surfaces **20*a*, 20*b* of the transverse legs and shank portion 26 counteract the force developed in bit 2 by forward motion of the cutting head. Forces arising in the vertical direction perpendicular to the direction of forward motion are accomodated by lower reaction surfaces 20*b* of legs 18 and by extension portion 28 engaging in mating groove 42. Extension portion 28 also serves to prevent sideways twisting movement arising during cutting. Now the forces arising from forward motion of the cutting head produce a couple between the head of the bit and the reaction surfaces 20*a* and 20*b*. This couple which would tend to prise holder part 14 out of its mounting is resisted by set screw 36 abutting against reaction surface 24. In addition, a couple is created between reaction surfaces 20*a*, 20*b* and the head of bit 2 by vertical forces acting on the head of the bit. This couple is resisted mainly by extension portion 28**.

The above bit holder of the type defined is popular on account of its solidity and resistance to movement. The bit holder is normally used in a continuous miner for board and pillar coal mining where the cutting head is normally formed as a rotating drum having its axis of rotation parallel to the coal face so that bits on the cylindrical surface of the drum cut into the coal face as the cutting head is moved up and down the coal face. The bit is suitable for use in such situations since the length of the bit is relatively small being about 6 inches from tip to base and the amount by which the bit advances while it is actually in contact with the coal face is relatively little. However the bit shown in FIGS. 1 and 2 is not as suitable for use in longwall mining applications. In longwall mining applications a cutting head is commonly provided comprising a drum rotating in a plane parallel to the coal face. Bits around the cylindrical surface of the drum cut by shearing into the coal face. The length of the bit in a longwall cutting head is relatively long being about 8 inches from tip to base. In addition the movement of the bit whilst in contact with the coal face is relatively large. This requires a bit having large clearances therearound in order not to create coal dust. It can be seen that the bit as shown in FIGS. 1 and 2 does not have large clearances in particular it has little rake clearance, by which is meant the clearance vertically beneath the tip and indicated by the region A in FIG. 1. It can be seen this region is small on account of the surfaces of the holder part extension portion 28, and the mounting of set screw 36. However it is necessary to have portion 28 and set screw 36 in these regions, among other reasons, to resist the couples referred to above created in use.

The common type of bit for longwall mining applications is shown in FIG. 3 and is configured in the general shape of an axe 50 with the axe cutting edge 52 being disposed in the forward direction of motion of the cutting head of the mining machine. The shank of the axe-like bit is secured in a holder 54 by a locking device (not shown). This type of bit has a wide rake clearance, i.e. the area beneath edge 52 and therefore does not create excessive coal dust. However a disadvantage of this type of bit is that on account of the more intricate shape it is far more expensive than the simple pointed shaped bit shown in FIG. 1, about 10 times more as expensive.

A bit holder of the two part type for use with a bit having a pointed head extending axially from a shaft has been used in longwall mining applications, and is shown in FIG. 4.

The bit holder comprises a holder part 60 having a part conical sleeve 62 having a bore 64 for receiving the bit 66. Bore 64 has a recess 68 for receiving a wedding band 70 of the bit. The sleeve is matingly engaged in a conical bore 72 of a base part 74, and the end 76 of the part conical sleeve extends through the end of the conical bore as a threaded bolt portion. A nut 78 secured on the bolt portion secures the sleeve within the conical bore. A plunger 80 extends from bit 66 and extends through bolt portion 76 and is provided for removing the bit from the holder by longitudinal movement of the plunger within the bore. An advantage of this arrangement is that it does have a relatively large rake clearance beneath bit 66. However a disadvantage is that the bit holder can only be used with the "wedding band" form of bit, referred to above, since the base end of the bit cannot project from the end of the bit holder in view of the length of the bit holder. The holder requires a plunger in order to dislodge the bit and this increases the expense of the bit holder.

This invention is particularly concerned with bit holders of the two part type having a base part for securing to the cutting head of a mining machine, and a holder part releasably secured to the base part and holding a bit, the bit being of the type having a pointed head portion axially extending from a shaft portion.

It is an object of the present invention to provide a bit holder of the two part type which can accept any form of securing of the bit in the holder but which provides a large rake clearance such as to permit the operation in longwall mining without the creation of excessive dust.

The present invention provides in one specific aspect a bit holder for a replaceable bit having a pointed head portion axially extending from a shaft portion, the bit holder having a holder part for receiving the bit and having a base part for securing to a cutting head, and means releasably securing the holder part to the base part, the holder part having at least one reaction surface co-operating with at least one reaction surface of the base part for counteracting forces arising on the bit in use of the cutting head, and said releasable securing means comprising a bolt means for extending from one of the holder part or base part into a co-operating aperture in the other of the holder part and base part for securement therein whereby to grip the holder part and the base part together with the reaction surfaces therebetween, and the bolt means being positioned relative to the reaction surfaces and the position of the bit so that the gripping force of the bolt means counteracts a couple created in operation between the head of the bit and the reaction surfaces.

In accordance with the invention by arranging that the gripping force of the bolt means should counteract the couple created in operation between the head of the bit and the reaction surfaces a very compact configuration of the holder part and base part can be arranged, with a large rake clearance. This is because in contrast with the arrangement shown in FIGS. 1 and 2 it is not necessary to have a set screw and front portions of the holder and base parts extending directly beneath the head of the bit in order to counteract the couples created during cutting. The bolt means may be integral with the base part or the holder part and extend into an aperture in the other of the base part or holder part where it is secured by means of a nut on the end of the bolt. Alternatively the bolt means may be separate from the holder part and base part and extend through registering apertures in the base part and holder part. It may either be secured by a nut or one of the apertures may be threaded to receive the bolt.

In order to ensure a compact arrangement of the bit holder and to provide clearly defined reaction surfaces which rest against one another properly, the reaction surfaces are reduced to a minimum, both in size and number, so that they remain adequate to counteract the stresses arising in use but are not so large as to increase the bulk of the holder. As preferred two sets of generally orthogonal reaction surfaces are provided for absorbing cutting forces in perpendicular directions. One set of reaction surfaces is for convenience disposed in a "vertical" plane by which is meant a lane perpendicular to the forward direction of movement in order to counteract forces arising in the forward direction of movement. The other set of reaction surfaces is disposed in a "horizontal" plane at right angles to the vertical plane. This lends itself to a particularly simple shape of holder part, comprising a shank portion extending from a sleeve portion the sleeve portion receiving the bit, the shank portion having a vertical side abutting the base part and containing vertical reaction faces and a horizontal bottom surface abutting the base part containing horizontal reaction faces. With such a simple shape of shank, it is easy and within manufacturing tolerances to provide a close mating of the holder part with the base part. This is necessary in order to permit the bolt apertures in the holder part and base part to register with one another across the interface between the two parts.

The vertical side having vertical reaction surfaces is preferably cut away to provide clearly defined upper and lower reaction surfaces, the upper reaction surface being disposed close to the sleeve portion so as to reduce stresses arising from the distance between the reaction surfaces and the bit tip. A lower reaction surface is provided adjacent the bolt apertures so that the bolt when secured grips the holder part and base part together across the lower reaction surfaces. The distance between the upper and lower reaction surfaces is such that the gripping force exerts a moment about the upper reaction surfaces which is sufficient to counteract the couple exerted between forward cutting forces exerted on the bit tip and the upper reaction surfaces. Since the upper reaction surfaces are disposed a relatively large distance from the bit tip, the lower reaction surfaces are likewise disposed a relatively large distance from the upper reaction surfaces. Thus the total distance between the cutting tip and lower reaction surfaces is relatively large and makes the holder suitable for longwall mining applications where the total height of the cutting tip above the base of the holder is about 8 inches.

The horizontal reaction surfaces disposed at the base of the shank of the holder part serves to counteract vertical forces arising on the bit tip. There is a couple created between the horizontal reaction surfaces and the bit tip. As preferred this is counteracted by a further bolt means extending between registering apertures in the holder part and bore part and disposed in such a position in relation to the horizontal reaction surfaces that the moment exerted between the further bolt means and horizontal reaction surfaces counteracts the couple.

As preferred the shank portion is groove shaped in section, with the groove disposed in the vertical side of the shank defining the reaction surfaces. The groove matingly engages a vertically disposed rib in the base part which provides resistance against sideways twisting forces arising during cutting. The upper and lower vertical reaction surfaces are defined by the free edges of the groove, and the lowermost horizontal reaction surfaces are defined by the end faces of the groove. An an alternative arrangement, the shank portion of the holder part may be T-shaped in cross-section and the co-operating base part may be groove shaped in cross-section so that the reaction surfaces are defined by the inner walls of the bar of the T.

The above arrangement is suitable for longwall mining applications since it provides a large rake clearance and provides the necessary height of the cutting tip over the base. However the bit holder according to the invention may be adapted for use with continuous miner applications, where it is not necessary for the tip to be at such a height relative to the base of the holder. In accordance with the invention, the main reacting surfaces for absorbing forces arising from forward motion of the cutting head which are in the above arrangement disposed beneath the sleeve of the holder part are in accordance with an embodiment for continuous mining provided on each side of the sleeve portion of the holder part. These reacting surfaces are preferably vertical and co-operate with vertical surfaces of the base part. The remainder of the holder part extends as a shank portion vertically beneath the upper vertical reacting surfaces to provide lower reacting surfaces adjacent registering bolt apertures for receiving the bolt for securing together the base part and the holder part. Thus the gripping force exerted on the lower reacting surface exerts a moment about the upper reacting surface which serves to counteract the couple which is created in use between the cutting tip and the upper reacting surface. In this embodiment the lowermost part of the holder part has a generally horizontal reacting surface for absorbing forces perpendicular to the direction of motion of the cutting head. In contrast to the first embodiment only a single bolt means is provided and this is positioned to exert a moment about the lowermost horizontal reacting surface in order to counteract the couple between the lowermost reacting surface and the bit tip in order to provide a secure mounting of the holder part to the base part. Although in this continuous mining embodiment the reacting surface portions of the holder part are raised relative to the sleeve part so as to make a more compact holder part there is nevertheless a wide rake clearance beneath the cutting tip since the bolt means are positioned beneath the upstanding sleeve. Thus compared with the arrangement shown in FIGS. 1 and 2 the bit holder provides a wide rake clearance which creates far less dust in board and pillar mining.

In a further aspect, the invention provides a bit holder for a replaceable bit having a pointed head portion axially extending from a shaft portion, the bit holder having a holder part for receiving the bit, and the bit holder having a base part for securing to the cutting head, and means releasably securing the holder part to the base part, wherein the holder part comprises a sleeve portion for receiving the bit and a shank portion extending beneath the sleeve portion the shank portion having a longitudinally extending side and an end engaging with the base portion and defining reaction surfaces disposed at an angle to one another for counteracting forces arising during operation of the cutting head.

In a further embodiment, the reacting surfaces of the holder part are provided as a generally part conical portion extending beneath a sleeve part for receiving the bit. The part conical portion extends into a part conically shaped bore in the base part and matingly engages in this part conical bore. A long bolt means extends from the rear end of the part conical bore and extends through a central bore in the conical portion of the holder part in order to securely engage the part conical part within the conical bore. Since the long bolt means can extend the whole length of the part conical part, a sufficient torque can be exerted for overcoming dimensional mismatching between the part conical part and the vertical bore to ensure a better seating than the known type of bit holder employing mating conical surfaces described above. The mating conical surfaces provide reaction surfaces which serve to counteract all the forces arising on the bit during a cutting operation. However if desired a locating lug may be provided vertically beneath the upstanding sleeve part for locating the holder part in a vertical direction.

Thus in a further aspect the present invention provides a bit holder for a replaceable bit having a pointed head portion axially extending from a shaft portion, the bit holder having a holder part with a bore for receiving the bit and a base part for securing to a cutting head, and means releasably securing the holder part to the base part, the holder part having a sleeve portion for receiving the bit laterally displaced from a reaction surface portion extending generally beneath the upstanding sleeve part, the reaction surface portion being part conical in shape and being matingly engaged in a part conical bore of the base part, and said releasable securing means comprising a bolt means extending through the part conical bore and a registering cylindrical bore in the part conical portion of the holder part.

In accordance with this further aspect of the invention, it is possible to provide a wide rake clearance for the bit holder since the conical surfaces may be mounted beneath and behind the upstanding sleeve part.

The invention will now be further described with reference to the accompanying drawings wherein:

FIG. 1 is a side view of a known kind of bit holder;

FIG. 2 is a side view in section of the bit holder of FIG. 1;

FIG. 3 is a side view of a further known kind of bit holder;

FIG. 10 is a diagram illustrating the relative end profiles of the various types of bit holder;

FIG. 11 is a schematic side view in section of a second embodiment of a bit holder in accordance with the invention.

Figure 4:
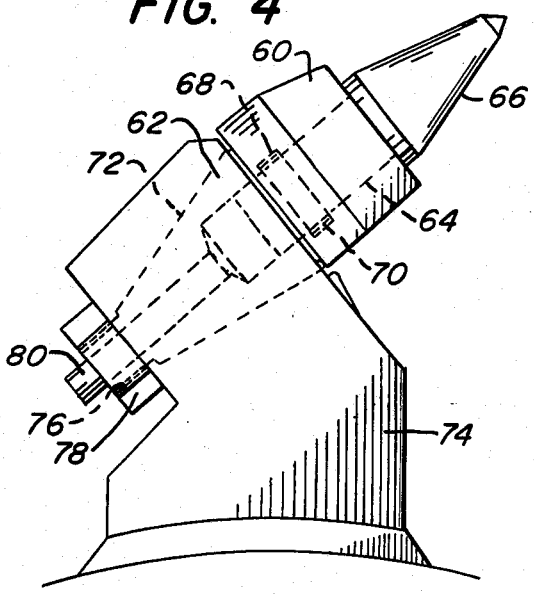
PRIOR ART FIG. 4
FIG. 4 is a side view of a further known kind of bit holder.
Figure 5:
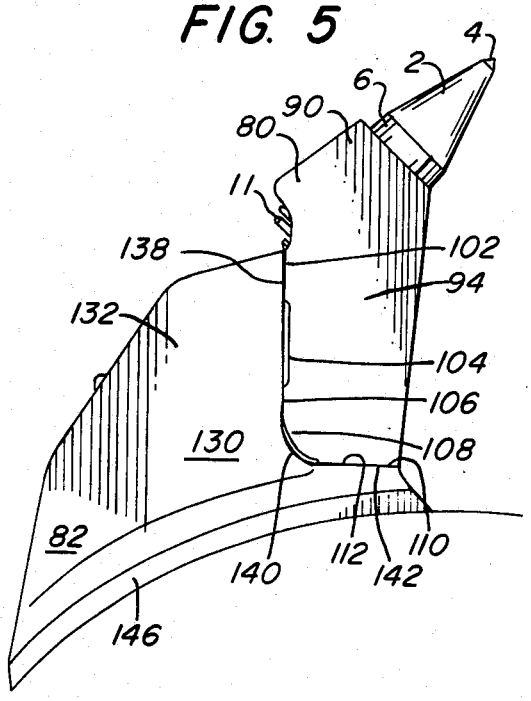
FIG. 5 is a side view of a first embodiment of a bit holder in accordance with the invention.
Figure 6:
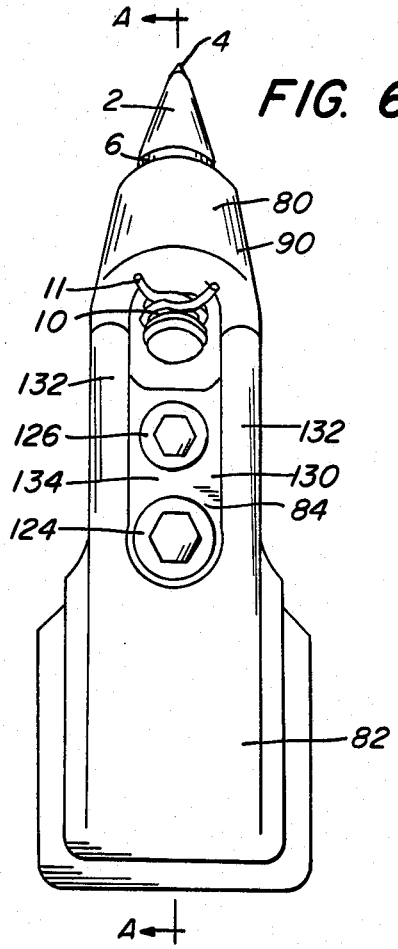
FIG. 6 is a rear view of the bit holder of FIG. 5.
Figure 7:
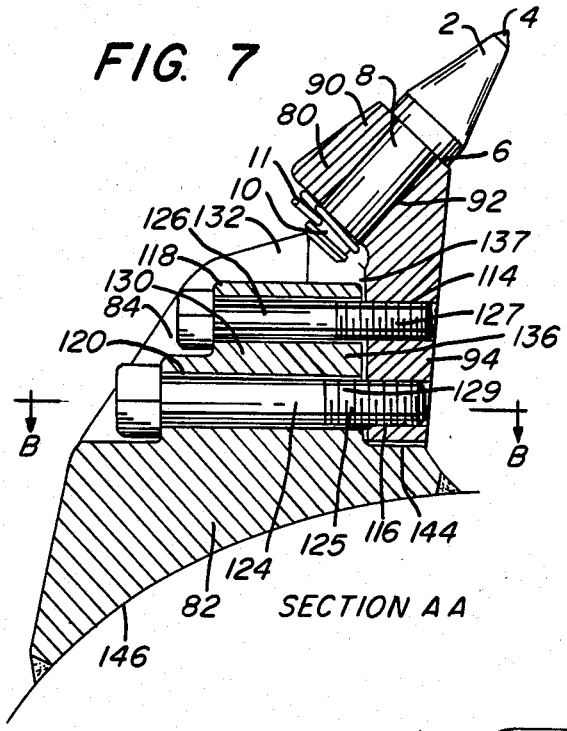
FIG. 7 is a sectional view of the bit holder along the line A—A of FIG. 6.

Referring now to FIGS. 5 to 8 illustrating a first embodiment of the invention, the bit holder is designed to accept the commonly used bit shown in FIGS. 1 and 2. That is the bit comprises a pointed conical head part 2 with a tungsten carbide tip 4, a square angled shoulder 6 at the base of the conical part 2 communicating with a axial shaft portion 8, the axial shaft portion 8 having at its rear end a groove 10 for accepting a hose clip 11. This type of bit is commonly used in the industry. Other types of bits may be employed for example, the type of bit employing a "wedding band", an expandable band mounted on the shaft of the bit which expands into a groove within a receiving bore of a bit holder. Another common type of bit is of a "pencil" shape where the pointed head merges into the shaft with no shoulder for transferring forces. The end of the shaft abuts an anvil for force transfer positioned at the base of the bore.

The bit holder comprises a holder part 80 for holding the bit and a base part 82 for securing the bit holder to a cutting head of a mining machine. Releasable securing means 84 are provided for securing together holder part 80 and base part 82 and to prevent any relative movement therebetween.

In more detail, holder part 80 comprises an upstanding sleeve portion 90 having a central bore 92 for receiving shaft 8 of bit 2 angled at about 40° to the vertical that is a plane perpendicular to the direction of forward motion of the cutting head. The rear end of bore 92 is open so that the end of the bit extends therethrough for affixing a hose clamp 11 to groove 10 of the shank.

Figure 8:
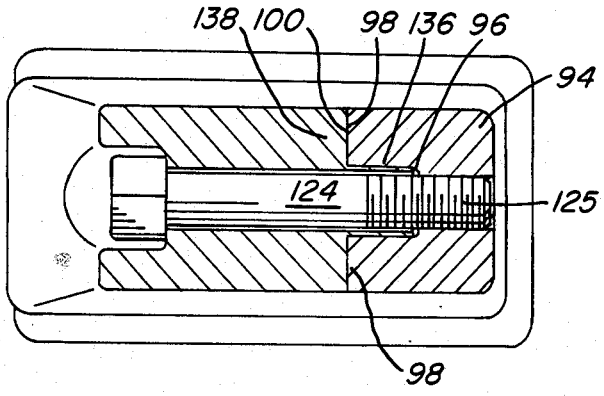
FIG. 8 is a sectional view along the lines B—B of FIG. 7 of the bit holder.

The remainder of the holder part comprises a shank portion 94 extending vertically downward beneath the upstanding sleeve part 90. Shank portion 94 has the shape of an elongate groove as shown in FIG. 8, with a groove 96 and side arms 98 having free edges 100. The groove 96 at the top of the shank portion communicates with the rear end of bore 92, in order to provide an open region for the affixing of a hose clamp 11 to groove 10 of bit 2.

The free edges 100 of the shank portion 98 provide at their upper ends reaction surfaces 102 disposed in a vertical plane abutting with reaction surfaces on holder part 82. Thus these reaction surfaces are provided directly beneath bit 2 and on either side of bit 2.

The remainder of the shank 94 extends vertically beneath reaction surfaces 102 and the free edges of the groove are cut away as at 104 in order clearly to define the upper reaction surface. Lower surfaces 106 are provided abutting with reaction surfaces on the base portion 82. The end of portion 94 curves around in a cutaway region 108 into a horizontal surface 110. Cutaway region 108 defines the lower end of lower reaction surfaces 106. The bottom ends of the walls of the groove of portion 94 form reaction surfaces 112 for absorbing vertical forces arising during cutting.

Shank 94 has two bores 114 and 116 which register with bores 118 and 120 in base part 82. These two sets of registering bores accept bolts 124, 126. Lower bolts 124 extends through bore 120 and has a screw threaded portion 125 which engages in a screw thread in bore 116. This bolt 124 serves firmly to secure the holder part 80 to base part 82 at the reaction surfaces 106. Upper bolt 126 has a screw threaded portion 127 which engages in a screw thread in bore 114. Bolts 124 and 126 are relatively long in order to ensure that appropriate tightening torques can be achieved and that there is sufficient elasticity in the bolt length to absorb settling arising during operation between the holder part and the base part. In the region between bores 114 and 116 the inner wall of the groove 96 is cut away as at 129 to insure proper seating of the remainder of the groove walls.

Base part 82 has a central portion 130 through which bores 118, 120 extend. The upper part of base part 82 and the rear region has upstanding side walls 132. Side walls 132 define recesses in which the heads of bolts 124, 126 are mounted and define together with groove 96 an open region 134 beneath bore 92 in order to permit access to the bit. The front of base part 82 has a vertical rib 136 which matingly engages within groove 96. The end of rib 136 is spaced from the base of groove 96 as at 137. On either side of rib 136 is a vertical surface 138 which provides a seating for the reaction surfaces 102 and 106 of holder part 80. The vertical surfaces 138 terminate in curved portions 140 which lead into a horizontal surface 142. Horizontal surface 142 provides a seating for reaction surfaces 112. The central portion of surface 142 is cut away as at 144 in order to clearly define the horizontal reaction surfaces. The lowermost part of base 82 has an arcuate extent 146 which serves as a welding surface for welding the base to the drum of a cutting head.

When assembled, the upper and lower vertical reaction surfaces 102 and 106 counteract forces arising from forward motion of the cutting head. Horizontal reaction surfaces 110 counteract forces arising in the vertical direction. Because of its simplicity of shape, it is possible accurately to seat holder part 80 in base part 82 while ensuring that the reaction surfaces are properly seated and that the bores 114, 116 properly register with bores 118, 120 in base part 82.

The engagement of rib 136 in the groove of holder part 80 and the engagement of the reaction surfaces on either side of the rib 136 provide resistance to sideways twisting forces exerted on the bit holder in use.

In use a couple is created between the tip of bit 2 and upper reaction surfaces 102. This couple is resisted by the moment of the gripping force of bolt 124 as exerted on lower reaction surfaces 106 about upper reaction surfaces 102. Similarly a couple is created between the tip of bit 2 and horizontal reaction surfaces 112. This couple is resisted by the moment of the gripping force created by bolt 126 about horizontal reaction surfaces 112.

The total height of the tip 4 above the cutting drum is about 8 inches. This is suitable for longwall mining applications. It can be seen that the rake clearance beneath the cutting the bit head is substantial and hence there is little obstruction to cutting operations.

Figure 9:
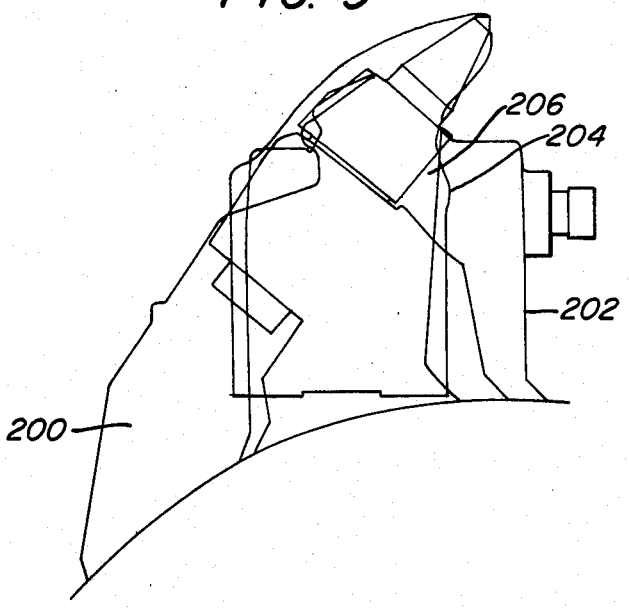
FIG. 9 is a diagram illustrating the relative rake clearances of the various types of bit holder described.

Referring now to FIGS. 9 and 10 the profiles of various types of bit holder are shown. In the side view of FIG. 9, 200 represents the side profile of the bit holder according to the invention shown in FIGS. 5 to 8. 202 represents the profile of the bit holder shown in FIGS. 1 and 2, 204 represents the profile of the bit holder shown in FIG. 3, and 206 represents the profile of the bit holder shown in FIG. 4. It may be seen that the rake clearance provided by bit holder 200 is comparable with the rake clearances provided by bit holders 204 and 206 and is far better than the rake clearance provided by bit holder 202. In FIG. 10, 210 represents the end profile of the bit holder according to the invention shown in FIGS. 5 to 8. 212 represents the end profile of the bit holder of FIG. 3, 214 represents the end profile of the bit holder of FIG. 4, and 216 represents the end profile of the bit holder according to FIGS. 1 and 2. It may be seen that the end profile 210 of the embodiment shown in FIGS. 5 to 8 is more narrow and is more effective in cutting than the other profiles with the exception of the profile of the embodiment shown in FIG. 3.

Figure 13:
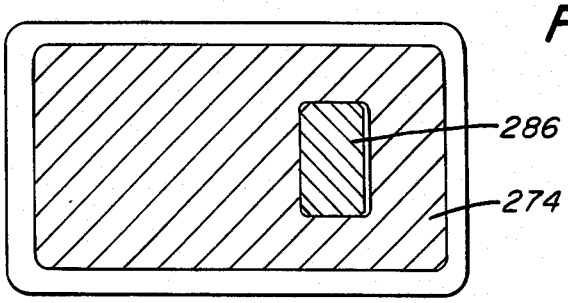
FIG. 13 is a sectional view along the line DD of FIG. 12.
Figure 12:
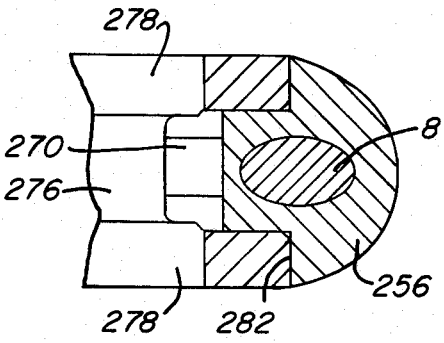
FIG. 12 is a sectional view along the line CC of FIG. 11.

Referring now to the embodiment of the invention shown in FIGS. 11, 12 and 13 which is a bit holder for continuous miner applications, the bit holder accepts the same bit as described above and a holder part 240 has an upstanding sleeve portion 242 is provided with a bore 244 for accepting the shank 8 of the bit. On either side of sleeve 242 near the base of the sleeve are provided transversely extending vertical reaction surfaces 254. A shank portion 256 of the holder part, generally rectangular in section, extends vertically beneath sleeve portion 242. The sleeve extends rearwardly in a portion 258, which portion provides a vertically extending rear reaction surface 260 along its rear surface. A lowermost part 262 of portion 258 extends downwardly and merges in a curved surface portion 264 with a horizontal reaction surface 266. A single horizontal bore 268 is provided for reception of a bolt 270, and the bore 268 is threaded to receive a threaded portion 272 of the bolt.

The base part 274 of the bit holder has a body 276 from which extend side wall portions 278 upwardly to provide a space 280 at the rear of bore 251 to enable fixing of bit 2. The side wall portions 278 provide vertically extending reaction surfaces 282 which co-operate with reaction surfaces 254 provided on either side of sleeve part 242. Side wall portions 278 extend downwardly from reaction surfaces 282 as shown in dotted lines and are cut away as at 284 in order clearly to define reaction surfaces 282. The side wall portions 278 extend downwardly on either side of shank portion 256 in order to embrace the shank portion to prevent it from twisting. An aperture 286 is provided at the base of base part 276 in order to receive portion 262 and to provide a vertical reaction surface 288 which co-operates with reaction surface 260 of portion 258. A horizontal reaction surface 290 is provided co-operating with surface 268. Base portion has a bore 292 to receive the shank of bolt 270, and a curved base wall 294 for welding to a drum of a cutting head.

In use the vertical reaction surfaces 254, 282, 260, 288 counteract forces arising on the bit tip in the forward direction of movement of the cutting tip. Vertically downward forces are counteracted by horizontal reaction surfaces 266, 290. Resistance to sideways twisting movement is provided by the pairs of surfaces wall portions 278 embracing shank portion 256. Bolt 270 acts securely to engage the base part with the holder part.

The force of securing as exerted on reaction surfaces 260, 288 exerts a moment about upper reaction surfaces 254, 282 which serves to counteract the couple created in operation between the bit 2 and upper reaction surfaces 254. In addition, there is a couple created in operation between bit 2 of the bit and the horizontal reacting surfaces 266, 290. On account of the smaller distance between the bit 2 and horizontal surfaces 266, 290 as compared with the first embodiment arising on account of the reaction surface 254 being disposed relatively higher in the second embodiment, the couple created by reason of vertical forces acting on the cutting tip is substantially smaller than the first embodiment. Hence it is unnecessary in contrast to the first embodiment to provide a second bolt providing a moment by reason of its securing force to counteract the couple about the horizontal reacting surface. In this second embodiment the force of securement provided by bolt 270 serves to provide a moment about the lowermost horizontal reacting surfaces 266, 290 to counteract the couple. Thus bolt 270 acts to counteract both the couples created around reacting surfaces 254 and also around reacting surfaces 266.

Figure 14:
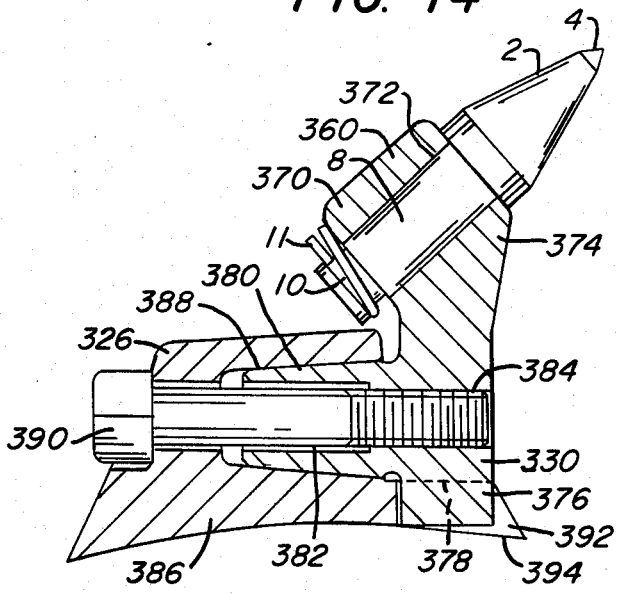
FIG. 14 is a schematic side view in section of a third embodiment of a bit holder in accordance with the invention.

Referring now to the third embodiment shown in FIG. 14, parts similar to that shown in FIGS. 5 to 8 are indicated by similar reference numerals. The bit holder comprises a holder part 360 having an upstanding sleeve portion 370 with a central bore 372 angled at about 40° to the vertical for receiving shaft 8 of bit 2. A shank portion 374 extends vertically downwardly from the upstanding sleeve portion and terminates in a lug portion 376, and on either side of lug portion 376 is disposed a horizontal reaction surface 378. Extending horizontally from shank portion 374 is a part conical member 380. Part conical portion 380 has a bore 382 extending through its whole length terminated in a screw threaded portion 384. The base part 386 comprises a part conical bore 388 in which the part conical portion matingly engages. A long bolt 390 extends from the rear open end of the bore into the cylindrical bore of the part conical portion in order to secure the holder part to the base part. The front portion of the base part has two side walls 392 extending on either side of the lug 376 of the holder part for securing the holder part against transverse twisting movement arising from cutting forces. The base of the lowermost surface 394 is arcuate in extent for welding to the cylindrical surface of a cutting head. The mating conical surfaces serve to counteract all horizontal and vertical reaction forces arising in use of the current head. Although it is difficult to manufacture the conical surfaces to precisely the same conical angle to ensure a proper seating one within the other, the provision of a long bolt securing the part conical part within the bore ensures that high tightening torques can be achieved. By reason of the longitudinal elasticity of the bolt, movement of the conical part within the bore during use because of settling of the part conical part within the bore, is absorbed by the elasticity of the bolt and a firm mounting of the part conical part within the bore is preserved.

The invention which will be claimed will be any of the novel arrangements hereinbefore described either singularly or in combination and may include but not necessarily be limited to the following:

1. A bit holder for a replaceable bit having a pointed head portion axially extending from a shaft portion, the bit holder comprising: a holder part for receiving the bit, a base part for securing to a cutter head, a means for releasably securing the holder part to a forward facing surface of the base part, the holder part having at least one reaction surface generally perpendicular to the direction of forward motion cooperating with at least one reaction surface generally perpendicular to the direction of forward motion on the base part for counteracting forces arising on the bit in use of the cutting head, said releasable securing means comprising a bolt means for extending from one of the holder part or base part into a cooperating aperature in the other of the holder part or base part for securement therein whereby to grip the holder part and the base part together with said reaction surfaces therebetween, and the bolt means being positioned relative to the reaction surfaces and the position of the bit so that the gripping force of the bolt means counteracts a couple created in operation between the head of the bit and said reaction surfaces.

2. A bit holder according to claim 1, wherein the bolt means extends from the side of said base part opposite said reaction surface generally perpendicular to the direction of forward motion of said bit holder through an aperature in the base part and extends into a threaded aperature in the holder part.

3. A bit holder according to claim 1, wherein each of said bit holding part and said base part have a set of cooperating generally perpendicular reaction surfaces for absorbing cutting forces acting in said generally perpendicular directions.

4. A bit holder according to claim 3, wherein one set of reaction surfaces on said bit holding part and said bore part is provided in a plane perpendicular to the direction of forward motion of the cutting head.

5. A bit holder according to claim 1 wherein the holder part comprises a shank portion extending from a portion thereon capable of receiving the bit, the shank portion including said reaction surface generally perpendicular to the direction of forward motion abutting said reaction surface generally perpendicular to the direction of forward motion of said base part and including an end at right angles to said reaction surface on said shank portion and abutting the base part.

6. A bit holder according to claim 5 wherein the reaction surface generally perpendicular to the direction of forward motion of said shank portion includes separate upper and lower reaction surfaces, the upper surface being disposed close to the bolt means.

7. A bit holder according to claim 6 wherein a second bolt means is provided extending through registering bolt aperatures in the holder part and base part and disposed in such a position in relation to said lower generally perpendicular reaction surface that the moment exerted between the second bolt means and lower generally perpendicular reaction surface counteracts a couple created between the bit tip and said lower generally perpendicular reaction surface.

8. A bit holder according to claim 5 wherein the shank portion is U-shaped in cross-section with the opening in the U-shaped cross-section disposed toward said generally perpendicular reaction surface therein and is capable of matingly engaging a longitudinal rib extending from said base part.

9. A bit holder according to claim 1 wherein the holder part comprises a generally upstanding bore for receiving the bit and main reaction surfaces generally perpendicular to the direction of forward motion are provided on the forward end of said bore for counteracting forces arising from forward motion of the cutting head.

10. A bit holder for a replaceable bit having a pointed head portion axially extending from a shaft portion, the bit holder having a holder part for receiving the bit, and a base part for securing to a rotatable cutting head, and means releasably securing the holder part to a forward facing surface of the base part, wherein the holder part comprises a bit holding portion capable of receiving the bit and a shank portion extending beneath said bit holding portion, the shank portion having a longitudinally extending side portion generally perpendicular to the direction of forward motion and a bottom portion disposed generally perpendicular to said longitudinal portion engaging with the base portion thereby defining reaction surfaces for counteracting forces arising during operation of the cutting head.

11. A bit holder for a replaceable bit having a pointed head portion axially extending from a shaft portion, the bit holder having a holder part with a bore for receiving the bit and a base part for securing to a cutting head, and means releasably securing the holder part to a forward facing surface of the base part, the holder part having an upper bit holding portion including a bore for receiving the bit and a lower reaction surface portion extending generally beneath the bit holding portion, the reaction surface portion being part conical in shape and being matingly engaged in a part conical bore in said base part, and said releasable securing means comprising a bolt means extending through the part conical bore and a registering cylindrical bore in the part conical portion of the holder part.

* * * * *